United States Patent [19]

Henderson et al.

[11] 4,138,757

[45] Feb. 13, 1979

[54] ULTRASONIC FILM CLEANING APPARATUS

[75] Inventors: David Henderson, Mundelein; David B. Digel, Chicago, both of Ill.

[73] Assignee: Research Technology, Inc., Lincolnwood, Ill.

[21] Appl. No.: 888,195

[22] Filed: Mar. 20, 1978

[51] Int. Cl.[2] ..... B08B 11/00

[52] U.S. Cl. ..... 15/100; 15/103

[58] Field of Search ..... 15/100, 103, 77; 352/130

[56] References Cited

U.S. PATENT DOCUMENTS

| | | | |
|---|---|---|---|
| 1,724,705 | 8/1929 | Frankenberg | 15/100 |
| 2,967,119 | 1/1961 | Gutterman | 15/100 X |
| 2,987,955 | 6/1961 | Sassenberg | 15/100 X |
| 3,019,464 | 2/1962 | Grunwald et al. | 15/100 |

*Primary Examiner*—Edward L. Roberts

*Attorney, Agent, or Firm*—Hill, Gross, Simpson, Van Santen, Steadman, Chiara & Simpson

[57] ABSTRACT

An ultrasonic liquid film cleaning device having means for moving a film strip at high speeds between a pair of oppositely moving cleaning strips. The cleaning strips and the film are positioned for movement between a pair of beds which act as guides and compression surfaces for the sandwiched assembly of cleaning strips and film. Cleaning fluid is piped to the bed to wet the cleaning strips and thereby assist in the cleaning action. An ultrasonic device is mounted in each bed to activate the fluid which is absorbed by the cleaning strips. This activation of the fluid increases the cleaning power of the strips as they pass against the film.

8 Claims, 4 Drawing Figures

Fig. 1
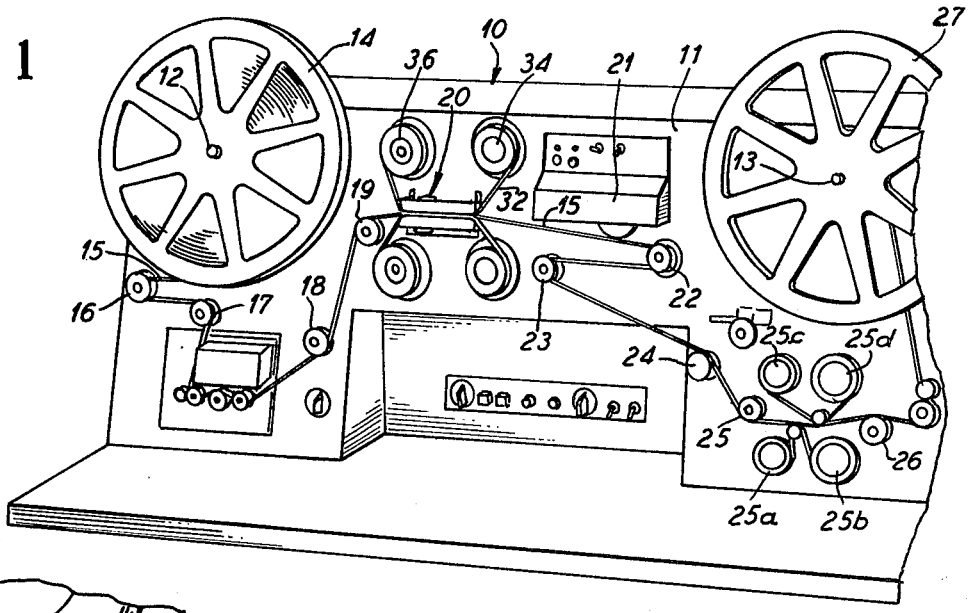
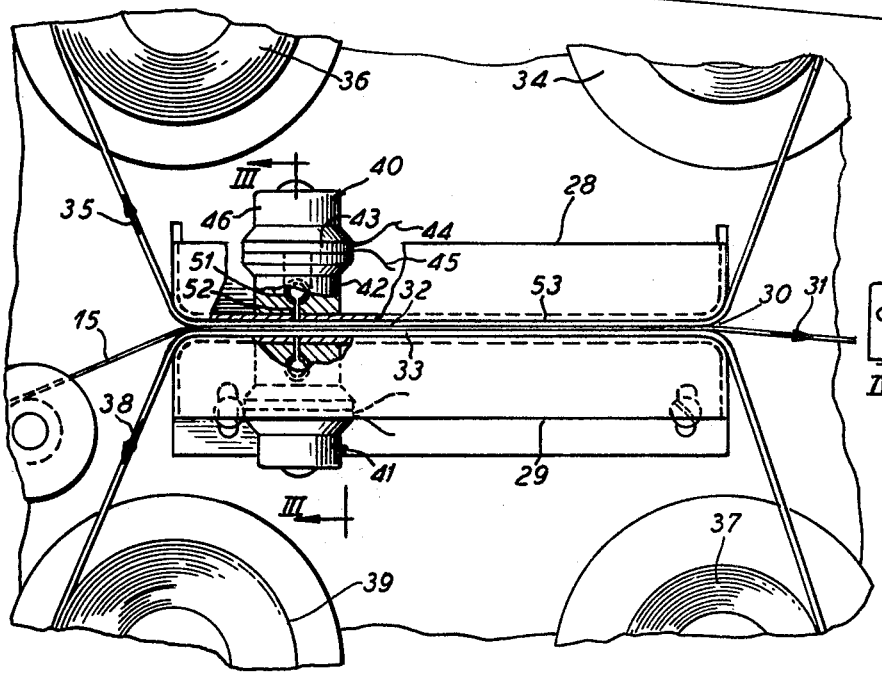
Fig. 2
Fig. 3
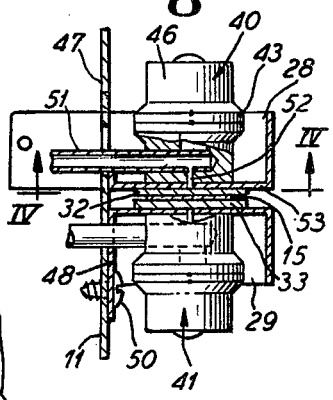
Fig. 4
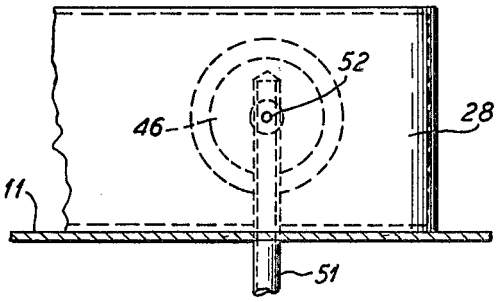

ULTRASONIC FILM CLEANING APPARATUS

BACKGROUND OF THE INVENTION

1. Field of the Invention

The field of art to which this invention pertains is film cleaning devices and in particular to a film cleaning device using ultrasonic means to improve the cleaning power.

2. Description of the Prior Art

Prior art cleaning devices for film have taken on two forms. One form consists of the use of moving cleaning strips, usually cotton cloth, which are pressed tightly against a moving film strip to wipe the surface of the film clean. The moving cotton cloth is continually moistened with a high solvent cleaning fluid.

Another type of device consists of an ultrasonic cleaner in which the film is passed through a fluid bath, and an ultrasonic device provides cleaning action on the film surface according to well-known ultrasonic cleaning principles.

SUMMARY OF THE INVENTION

It is an important feature of the present invention to provide an improved film cleaning device.

It is another feature of the present invention to provide a device which has improved film cleaning power without significantly increasing the cost of the cleaning apparatus.

It is a principal object of the present invention to provide an ultrasonic film cleaning device which functions in conjunction with fluid contained in a moving cleaning cloth strip.

It is also an object of the present invention to provide an ultrasonic film cleaner without the use of the usual ultrasonic bath.

It is a further object of the invention to provide an ultrasonic cleaner of the type described above wherein a pair of cleaning cloth strips are positioned between a pair of beds in such a way as to sandwich the film between the cloth strips. Means are provided to wet the cloth strips with a high solvent fluid and an ultrasonic device is positioned in each bed to cause cavitation of the cleaning fluid at the interface between the film and the associated cleaning cloth strips.

These and other objects, features and advantages of the present invention will be understood in greater detail from the following description and the associated drawing wherein reference numerals are utilized to designate a preferred embodiment.

BRIEF DESCRIPTION OF THE DRAWING

FIG. 1 is a front plan view of a film cleaning machine according to the present invention.

FIG. 2 is an enlarged view of the film cleaning beds shown in FIG. 1 illustrating the positioning of the ultrasonic devices at those beds.

FIG. 3 is a sectional view taken along the lines III—III of FIG. 2.

FIG. 4 is a sectional view taken along the lines IV—IV of FIG. 3.

DESCRIPTION OF THE PREFERRED EMBODIMENT

The film cleaning apparatus of the present invention is an improvement over prior known cleaning devices in that improved cleaning results while minimizing the cost of construction and use of the machine.

In the past, the available choices in cleaning apparatus have been between a wiping cleaning action and an ultrasonic cleaning action; the ultrasonic cleaning action being of a well-known variety where the ultrasonic cleaner acts in a bath of cleaning fluid, while the film is passed through the bath. The present invention derives, in part, from the discovery that an ultrasonic unit could be applied to cloth cleaning strips moistened with cleaning fluid without the need to provide a bath for the fluid which is considerably more costly.

Referring to the drawings in greater detail, a film cleaning apparatus 10 is shown in FIG. 1 as including a housing or cabinet 11 on which is mounted a pair of spindles 12 and 13. A supply reel 14 is mounted on the spindle 12 and contains a film which is in a position to be cleaned. The film may be threaded around a series of pulleys such as 16, 17 to a film flaw detection device 17*a*. It is then fed past pulleys 18 and 19 to the basic film cleaning apparatus 20. Exiting from the film cleaning apparatus 20, the film 15 passes beneath a vent hood 21 and around a series of further pulleys 22, 23, 24, 25 and 26 and eventually is wound about a take-up reel 27 which is mounted on the spindle 13. Cloth strip reels 25*a*, *b*, *c* and *d* provide a dry cleaning action as shown to remove dust particles from the film.

Referring more specifically to the portion of the apparatus 10, which is the subject of the present invention, namely the film cleaning device 20, FIG. 2 shows that the film 15 is passed between a pair of beds 28 and 29 and exits from the beds at point 30. In operation, the film is travelling at a relatively high speed in the direction of the arrow 31 and passes between a pair of cotton cleaning strips 32 and 33 which provide a wiping action for the upper and lower surfaces of the film. The cloth strip 32 is supplied from a supply reel 34 and passes between the beds 28 and 29 in the direction of the arrow 35 in FIG. 2. It is then wound on a take-up reel 36.

Similarly, the cotton cleaning strip 33 is taken from a supply reel 37 and passes against the lower surface of the film 15 while it is between the beds 28 and 29. This cotton strip travels in the direction of an arrow 38 and is received by a take-up reel 39. The cotton strips 32 and 33 travel at approximately the same speed with respect to the speed of the film 15. It is to be noted that the film 15 moves in a direction which is opposed to the direction of movement of the cotton strips 35 and 38.

This apparatus is a wet cleaning system using a highly solvent film cleaning solution. The beds 28 and 29 are each provided with ultrasonic devices 40 and 41, respectively. More detail on these devices is available in FIGS. 3 and 4.

The device 40 (or 41) consists of a housing 42 and includes a piezoelectric crystal 43 having a pair of leads 44 and 45. A tail mass 46 may be mounted against the crystal to add in directing sonic waves inwardly toward the bed 28.

As shown in FIG. 3, a bed is mounted to the housing 11 at flange 48. The mounting is accomplished by a pair of screws 50 as shown. The top bed is moveable with a hinge point behind the panel 11 to facilitate loading film and cleaning tapes. A conduit 51 is passed through the housing wall 11 and received interiorly of the ultrasonic device 40 as shown. A feed port 52 conducts from the conduit 51 to points below the horizontal surface 53 of the bed 28. The conduit 51 passes fluid from a fluid reservoir into the interior of the ultrasonic device and through the feed port 52. From here the fluid is passed directly onto the cloth cleaning strip 32. In this way, the cloth cleaning strip is moistened by the fluid and becomes a more effective wiping material for the film itself. A similar arrangement is provided in connection with the ultrasonic device 41. The fluid is under pressure and can exit in a vertically upward direction in connection with the ultrasonic device 41.

As the film passes at high speed in the direction shown at 32, and the cleaning strips travel in the direction shown at 35 and 38, fluid is applied to the cleaning strips continually through the feed ports such as 52. The ultrasonic devices 40 and 41 cause the fluid to cavitate at both the upper and lower surfaces of the film 15. This cavitation causes dirt particles to vibrate from the film surface and to penetrate into the cloth strips 35 and 38. Because the dirt particles are vibrated as opposed to being merely "wiped-off" the film, they are caused to penetrate deeper into the fabric of the cotton strips rather than merely residing on the surface of those strips. Hence, the surface of those strips becomes less clogged with dirt particles. This not only increases the cleaning ability, but also decreases the opportunity for dirt particles to offer abrasion to the passing film surface.

By increasing the cleaning ability of the apparatus shown in FIG. 2, it is also possible that a less highly solvent and less volatile cleaning fluid could be employed while maintaining high cleaning characteristics. As can be seen in these drawings, this is accomplished without the use of a cleaning bath normally associated with ultrasonic cleaning devices.

It will be apparent that modifications of the general features of this invention could be accomplished by persons skilled in the art without departing from the invention, but we desire to claim all such modifications as properly come within the scope of our invention as described herein.

We claim:

1. An apparatus for cleaning a moving strip comprising:

a cleaning plane, means for mounting the strip for relatively high speed movement within said cleaning plane, means for positioning an absorbent cleaning medium against at least one surface of the moving strip and for providing continuous relative movement between the absorbent cleaning medium and the strip, means adjacent the cleaning plane for moistening the absorbent cleaning medium with a cleaning solution, and means providing ultrasonic cleaning waves within the moistened absorbent cleaning medium at the cleaning plane to enhance the cleaning action.

2. An apparatus in accordance with claim 1 wherein said means for positioning said absorbent cleaning medium against said moving strip comprises:

a stationary bed, means for positioning one side of said cleaning medium against said bed, means for positioning the moving strip against the other side of the cleaning medium, and means for moving the cleaning medium relative to the strip.

3. An apparatus in accordance with claim 2 wherein an additional bed is provided in juxtaposition to the first mentioned bed, the moving strip passing between the respective beds, a second absorbent cleaning medium positioned against the second bed, the strip being sandwiched between the two mediums, and the two mediums being held against opposite surfaces of the strip by the pressure provided by the respective beds.

4. An apparatus in accordance with claim 3 wherein said means for providing ultrasonic cleaning waves within the cleaning medium comprise an ultrasonic device positioned in each of said first and second beds.

5. An apparatus for cleaning a moving strip comprising:

first and second beds juxtapositioned with respect to each other, the moving strip passing between the beds, an absorbent cloth tape passing between a first surface of the strip and one of the beds, a second absorbent cloth tape passing between the opposing surface of the strip and the other bed such that the strip passes between the cloth tapes, the beds providing proper compression therebetween to allow a desired wiping action of the tapes against the strip, an ultrasonic device mounted in each of the beds and directing ultrasonic waves to the respective absorbent cloth tapes, and means directing cleaning fluid to the respective absorbent cloth tapes at a location which allows the ultrasonic devices to energize the cleaning fluid against the surface of the strip.

6. An apparatus for cleaning a moving strip in accordance with claim 5 including means for piping fluid directly to the interior of the ultrasonic devices and from the interior of said devices directly to the absorbent cloth tape which is positioned at opposite sides of the strip to be cleaned.

7. An apparatus for cleaning a moving strip in accordance with claim 6 wherein said absorbent cloth tapes pass across their respective beds from respective supply reels to take-up reels and are moved in a direction opposite to the direction of movement of the strip.

8. An apparatus in accordance with claim 7 wherein said beds are elongated in configuration, the beds defining a feed end and an exit end for the absorbent cloth tapes, and the ultrasonic devices being positioned near said exit end.

* * * * *